United States Patent [19]

Conklin, Jr.

[11] 4,127,051

[45] Nov. 28, 1978

[54] PIANO KEY FRAME

[75] Inventor: Harold A. Conklin, Jr., Cincinnati, Ohio

[73] Assignee: D. H. Baldwin Company, Cincinnati, Ohio

[21] Appl. No.: 834,473

[22] Filed: Sep. 19, 1977

[51] Int. Cl.[2] ..... G10C 3/12

[52] U.S. Cl. ..... 84/423; 84/432; 84/434; 84/439

[58] Field of Search ..... 84/174, 176, 177, 186, 84/243, 250, 423, 430, 432–436, 439

[56] References Cited

U.S. PATENT DOCUMENTS

| | | | |
|---|---|---|---|
| 952,509 | 3/1910 | Caulfield | 84/432 |
| 2,505,805 | 5/1950 | Stein | 84/177 X |
| 3,072,005 | 1/1963 | Quitter et al. | 84/174 |
| 3,381,576 | 5/1968 | Johnson | 84/439 |

*Primary Examiner*—Lawrence R. Franklin
*Attorney, Agent, or Firm*—Melville, Strasser, Foster & Hoffman

[57] ABSTRACT

A piano key frame assembly comprising a rigid metal frame, preferably formed from aluminum tubing, for supporting the piano keys and action, the frame having a front rail, an intermediate balance rail and a back rail, the back rail mounting adjustment means for leveling the keys, the key frame having adjustable feet by means of which it is positioned and leveled within the piano case, the conventional key bed being replaced by relatively narrow key bed brackets extending along the opposite sides of the case on which the adjustable feet are supported, means being provided to align and maintain the key frame on the key bed brackets.

17 Claims, 10 Drawing Figures

PIANO KEY FRAME

BACKGROUND OF THE INVENTION

This invention relates to pianos and has to do more particularly with an improved key frame for use in a grand piano wherein the key frame, keys, and action normally can be removed as a unit from the piano case so as to provide easy access to the parts when it becomes necessary to work on or to adjust any of them.

The key frame in a conventional piano is normally a relatively flexible structure formed from an assembly of wooden rails which define a supporting frame. Usually the key frame comprises a series of three parallel or nearly parallel wooden main rails interconnected by a series of crossrails located along the main rails at spaced apart intervals and arranged generally at right angles to the main rails. Each of the three main key frame rails is nearly as long as the width of the piano and somewhat longer than the total width of the array of keys. These main rails normally are referred to as the front rail, the balance rail and the back rail, named in the order of increasing distance from the front of the piano into which the key frame is placed. The main rails lie approximately at right angles to the lengths of the keys and each serves a particular purpose.

The front rail is located below and adjacent the fronts of the keys, lying beneath their playing surfaces where the front rail serves as a stop against which the keys can bottom when they are depressed to play the piano. The keys are guided in their up-and-down motion at the front rail by means of polished vertical pins which are driven into the front rail, usually one pin for each key. The pins project upwardly from the top of the front rail and mate with feltlined holes projecting upwardly from the bottoms of the keys to a depth which depends upon the up-and-down key position. These front rail pins locate the keys at the front of the piano and permit them to move up-and-down freely while restricting sidewise motion so as to prevent adjacent keys from contacting each other. Customarily a felt washer, known as a "punching", is placed over each pin so that, when the key bottoms, the felt "punchings" will lie between the bottoms of the keys and the key frame front rail to prevent undesirable noise. In addition, paper washers normally are placed under the felts in whatever number and thickness is required to regulate the extent of up-and-down key movement or "depth of touch" of the keys.

The balance or middle rail acts as a fulcrum for the keys. Each key is positioned both left and right and fore-and-aft at this fulcrum by another essentially vertically disposed pin driven into the balance rail. These pins are received in slot-like openings projecting upwardly from the bottoms of the keys so as to allow the keys to pivot fore-and-aft in the normal piano playing motion without permitting excessive side play or fore-and-aft sliding motion of the keys. At the balance rail the bottoms of the keys also rest on felt punchings placed over the balance rail pins; and paper punchings of various sizes and in the correct number are placed beneath the felt punchings to obtain accurate key leveling, i.e., to adjust the height of the playing surface of each key to be the same from key to key when the keys are at rest in their non-depressed or "key-up" position.

The third rail or so-called back rail functions as a resting point for the rear portion of each key, the back rail in combination with the height of the balance rail and number of balance rail punchings determines the angle of the keys and the elevation of the front portions of the keys when they are at rest. Normally the back rail is covered with a continuous strip of felt running lengthwise along the rail on which the rear undersurfaces of the keys rest when the key fronts are in their at rest or "key-up" positions. In a conventional piano there usually is no adjustment of key position made at the back rail.

In addition to mounting the keys in the manner described, the key frame also mounts the so-called action or mechanism by means of which the motion of the keys during the playing of the piano is translated into the motion of a set of felt covered hammers which strike the piano strings, exciting them to vibrate. The nature and exact arrangement of the action which, for each key, comprises a mechanical system of levers and pivots, is not important to the present invention and there are numerous variations which may be utilized in connection with the invention. Generally speaking, however, the action consists of a framework comprising two rails disposed generally parallel to the front width of the piano, the first comprising an upper or hammer rail on which the hammer assemblies are mounted, and the second comprising a lower or wippen rail on which the wippen assemblies are mounted, the wippen assemblies serving to actuate the hammers when the keys are stuck. The hammer and wippen rails are mounted in spaced apart relationship by five or six so-called action brackets mounted on the key frame at spaced apart intervals, the action brackets usually being secured to the crossrails of the key frame, which are preferably spaced apart at intervals of several centimeters to coincide with the location of the action brackets. The action brackets are provided with foot-like flanged projections on their bottom surfaces which are drilled to accept mounting screws by means of which the brackets are secured to the key frame structure with the hammer and wippen rails positioned so that each hammer and wippen assembly is in proper position to cooperate with the appropriate key on the key frame to strike the correct strings for a given note. It will be understood that there are various ancillary weighting and regulating adjustments to make the parts function properly and have the correct touch weight, but these matters are familiar to the piano builder and, as such, do not constitute a part of the present invention.

A complete key frame-key action assembly may weigh on the order of 30 kilograms or more and hence must have substantial support when it is placed in the piano case. In order to support this rather massive assembly, the conventional grand piano case is provided with a supporting shelf called the key bed, which is a heavy and expensive assembly normally consisting of several interconnected wooden rails extending across the front of the piano case to provide a supporting shelf for the key frame. The key bed so-formed is rigidly connected to the piano case so as to become essentially an integral part of the piano case. Because of mechanical coupling existing between the key bed and the piano soundboard via the various parts of the piano case, some portion of any vibrations originating at the key bed will be transmitted through the frame of the piano to the soundboard to produce undesirable knocking or extraneous noise components which may interfere with or detract from the tonal beauty of the instrument when it is played. Consequently, when the key frame-key action assembly is installed in the piano case the rails of the key frame must be in intimate contact with the key bed which supports the entire weight of the assembly. If such intimate contact is not achieved, as for example where small clearances exist between the key frame and the key bed, the key frame will impact against the key bed when the piano is played, and an undesirable knock in the tone may result. In this connection, it must be understood that in a grand piano it is necessary to shift the entire key frame-key action assembly laterally with respect to the strings in order to provide for the use of the una-corda pedal. Conventional musical notations require the use of such a pedal to move the action so that not all of the strings of a given note are struck by the piano hammers. This is done in order to produce a certain tonal effect; and in grand pianos the accepted practice is for the entire key frame to be shifted by sliding it relative to the key bed. Consequently the key frame must be free to shift on the key bed and hence the key frame cannot be rigidly fastened to the key bed by screws or bolts which would otherwise prevent slight changes in the shape of the key frame from producing knocks due to the resulting gaps.

In order to prevent undesirable knocking the key bed must be carefully constructed of properly dried wood so that any tendency to warp will be minimized, and after attachment of the key bed to the piano case, it must be carefully planned so as to be flat and level. Similarly, the key frame heretofore has been made of properly dried, unwarped, straight wooden rails which must be carefully fitted to the key bed. After the initial mating of the key frame and the key bed, small amounts of wood must be carefully removed from the key frame front rail by hand-sanding in order to secure an absolutely perfect fit so as to prevent knocks or thumps at the front rail when the piano is played. In order to reduce the amount of effort involved in fitting the parts together, the bottoms of the front and back key frame rails usually are planed or machined to have a slight bevel so that only one edge of each rail will be in contact with the key bed. In addition, the balance rail normally does not contact the key bed directly but rather is supported at intervals by adjustable support screws installed in the balance rail. Such screws are necessary because without them it would be extremely difficult, if not impossible, to achieve a satisfactory and knockless fit between the key frame and the key bed. Even if a satisfactory fit can be initially achieved, it is very difficult to maintain such fit over a long period of time in use. Changes in temperature and relative humidity can affect the shape of the parts and cause warping or changes in the dimensions of the parts which are sufficient to cause a knock to appear even when the key frame to key bed fit is initially correct. In addition, even when the fit is correct, the relatively large area of intimate contact between the key frame and key bed may transmit too much key-bottoming impact noise to the piano soundboard.

With the foregoing background in mind, the purpose of the present invention is to provide a novel key frame-key bed construction which effectively eliminates the difficulties inherent in conventional wooden constructions.

SUMMARY OF THE INVENTION

In accordance with the present invention, the key frame is constructed of metal, preferably aluminum tubing, and as such is a much stiffer, less yielding structure than the conventional wooden key frame.

The increase in stiffness of the key frame is such that it does not require a cooperating key bed to support it through its center portion. Rather, the key frame is attached to the rim structure of the piano case only at each end of the key frame, the rim structure being provided with a pair of essentially rigid metal brackets, preferably formed from steel, such brackets being rigidly secured to the opposite sides of the rim structure in positions to readily support the entire weight of the key frame. Thus, the need for an expensive and heavy key bed is eliminated as far as the requirement to support the key frame-key action assembly is concerned. Consequently, the area underlying the key frame can be closed by a bottom cover of greatly reduced weight and thickness.

The present invention also eliminates the problem of laboriously obtaining a precise fit between the key bed and the key frame. Fitting the key frame to the piano case is extremely simple in that the key frame is supported only at its opposite ends on a pair of brackets which replace the conventional key bed; and further, the key frame is supported at only four points by means of a set of feet positioned adjacent the four corners of the key frame. While preferably each of the four feet is adjustable, a correct and permanent fit can be obtained if only one of the four feet is made adjustable. In addition, adjustable stops can be readily provided to obtain front-to-rear alignment of the key frame relative to the case; and both the supporting feet and the adjustable stops facilitate lateral shifting of the key frame when the una-corda pedal is used. Because of the very limited contact area between the frame and the piano case, the transmission of thumps or other undesirable noises from the action, keys, and key frame through the piano case to the soundboard is greatly reduced, thereby enhancing the tone of the instrument. Noise is further reduced by the absence of a conventional key bed in contact with the key frame since the bottom of the key frame itself does not come into direct physical contact with the brackets which form a vestigial key bed. In this connection, the bottom cover is also out of direct contact with the key frame and again reduces the possibility of the transmission of undersirable vibrations to the soundboard.

Another advantage of a key frame construction in accordance with the present invention lies in its ability to be more accurately regulated on the workbench than can a conventional key frame-key action assembly. In a conventional assembly, the lack of stiffness of the key frame causes small changes in the relative positions of critical parts which affect action regulation so that if the action is regulated outside the piano case, it must be again regulated in the case in order to be certain the critical adjustments are correct. A metal frame constructed in accordance with the present invention, because of its stiffness, can be much more accurately regulated outside the piano case since critical adjustments would not be adversely affected by subsequent fitting of the assembly into the case.

A key frame constructed in accordance with the present invention also lends itself to an improved arrangement for adjusting the heights of the fronts of the keys when they are in their key-up positions. The rear of each key rests on a threaded dowel which determines the elevation of the playing surface of the key when in its at rest position. A dowel is provided for each key, the dowels being adjustably mounted on the back rail (or an extension of the back rail), the dowels being supported on threaded pins so that they may be raised or lowered by rotating them in opposite directions. With this arrangement it is not necessary to adjust the key height by utilizing punchings under the balance rail, which is an inconvenient operation in that the action must be loosened or removed from the key frame rails and the keys must also be removed in order to change the number of punchings.

DESCRIPTION OF THE PREFERRED EMBODIMENTS

Figure 1:
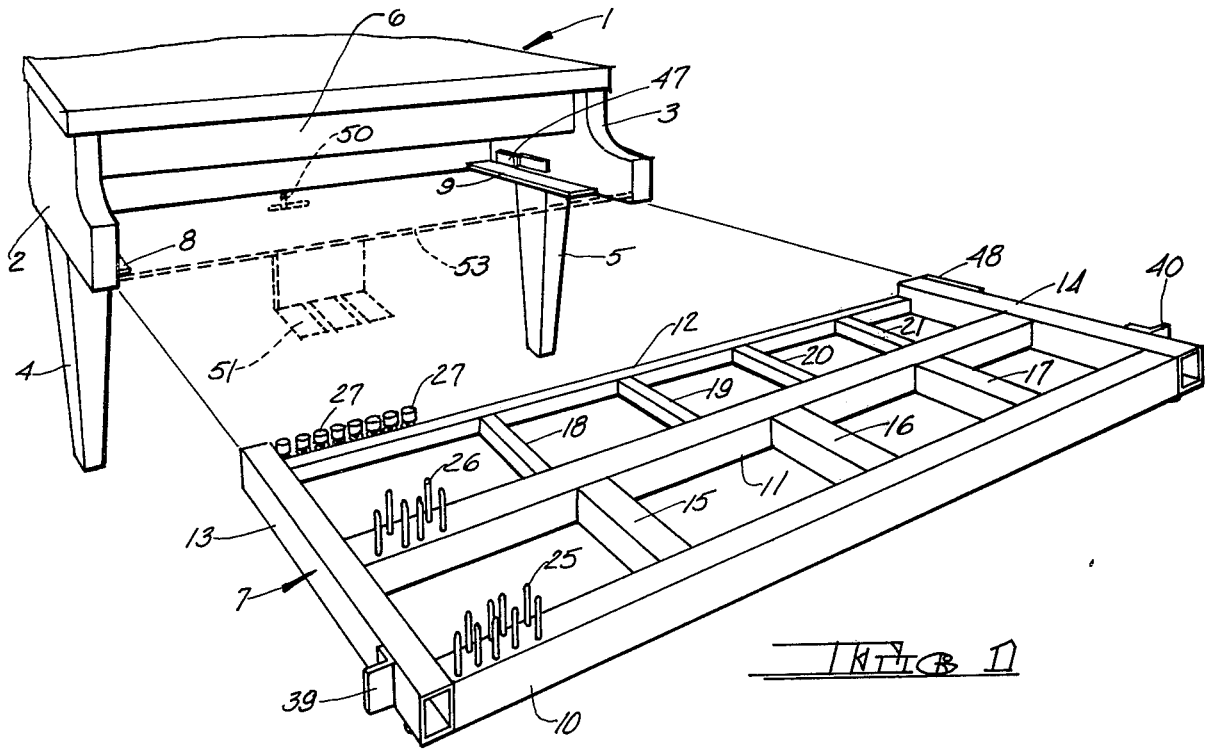
FIG. 1 is a fragmentary exploded perspective view illustrating the manner in which a key frame in accordance with the invention is fitted to the case for a conventional grand piano.

Referring first to FIG. 1, the case for a grand piano is generally indicated at 1, the case having a rim structure including opposing side wall members 2 and 3 supported by front legs 4 and 5, respectively. The case may be of conventional wooden construction in which event the opposite side wall members 2 and 3 will be integral with the reversely bent rear portion of the rim structure which will conform to the conventional configuration of a grand piano, including a supporting rear leg (not shown). Alternatively, the case may be constructed in whole or in part from other materials, such as steel or plastic. It will be understood that the case will have suitable transverse bracing members, one of which is indicated at 6, which act to strengthen and stiffen the rim structure.

A key frame in accordance with the invention is indicated generally at 7, the key frame being adapted to be slidably received in the case, being inserted from the front and supported on an opposing pair of key bed brackets 8 and 9 secured to the opposing side members 2 and 3, respectively. The key bed brackets 8 and 9 form the sole support for the key frame 7.

Figure 2:
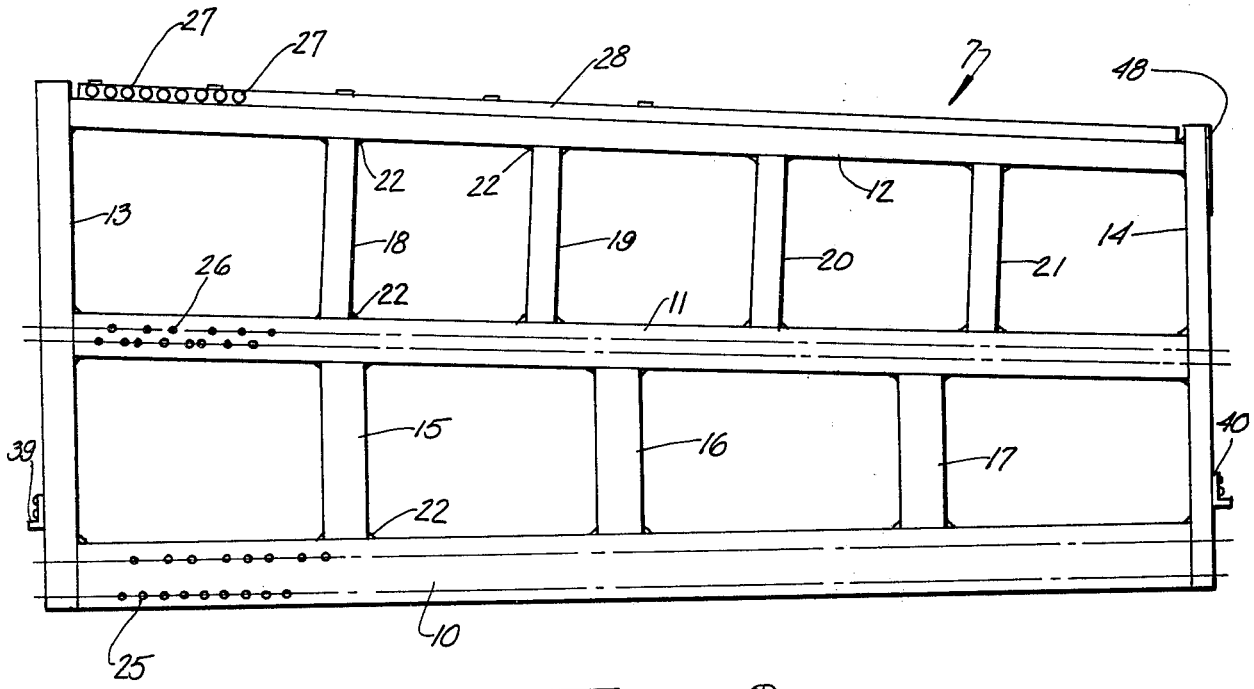
FIG. 2 is an enlarged plan view of a key frame in accordance with the invention.
Figure 2A:
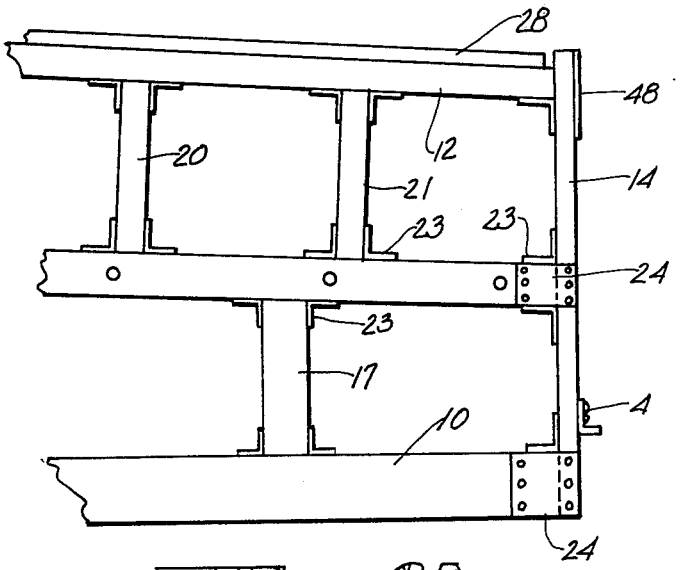
FIG. 2A is a fragmentary plan view similar to FIG. 1 illustrating a modified form of key frame construction.

In accordance with the invention the key frame is formed from metal, preferably hollow rectangular aluminum tubing, the key frame having a series of three main rails, namely, a front rail 10, a balance rail 11 and a back rail 12. The main rails are joined together at their opposite ends by end rails 13 and 14, and intermediate their ends by a first series of crossrails 15, 16 and 17 extending between front rail 10 and balance rail 11, together with a second series of crossrails 18, 19, 20 and 21 extending between the balance rail 11 and the rear rail 12. In the embodiment illustrated in FIG. 2, the various rails are welded together, as indicated by the weld lines 22, to form a rigid frame. Alternatively, as illustrated in FIG. 2A, the rails may be joined together by angle brackets 23 the flanges of which are bolted, riveted or otherwise secured to the rails being joined; and the structure may be further strengthened by reinforcing plates 24 bridging the junctures of the rails.

While the size of the rails does not constitute a limitation on the invention, in an exemplary embodiment the front rail is 3 inches wide and 2 inches deep, the balance rail is 2 inches wide and 2 inches deep, and the back rail $1\frac{1}{4}$ inches wide and $1\frac{1}{4}$ inches deep. End rail 13, which is at the bass end of the key frame, is $1\frac{1}{2}$ inches wide and 2 inches deep, and the end rail 14 at the treble end is 1 inch wide and 2 inches deep. The crossrails 15, 16 and 17 are 2 inches wide and 2 inches deep, and the crossrails 18, 19, 20 and 21 are $1\frac{1}{4}$ inches wide and $1\frac{1}{4}$ deep, and all of the rails making up the key frame have their bottom surfaces lying in a common plane. As will be evident from FIG. 2, the width of the key frame is somewhat greater at its bass end (at end rail 13) then it is at its treble end (at end rail 14), and the main rails 10, 11 and 12 are inclined relative to each other in the manner illustrated.

The front rail 10 will be provided with the customary key receiving vertical pins 25; and similarly, the balance rail 11 is provided with key receiving vertical pins 26, both sets of pins being either driven into holes bored in the upper surface of the rails or the pins and holes provided with mating threads.

Figure 6:
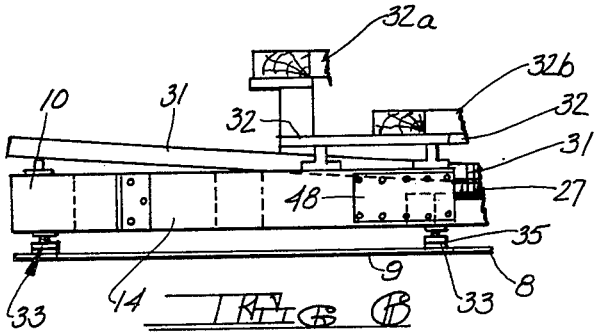
FIG. 6 is an end elevational view of the key frame illustrating the position of the keys and also the brackets and rails forming a part of the action.
Figure 7:
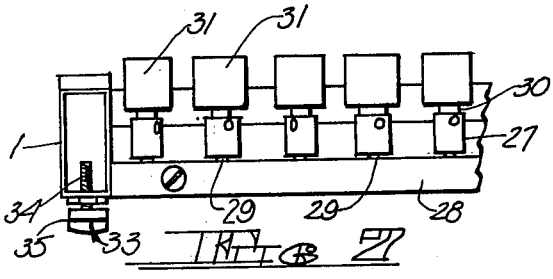
FIG. 7 is an enlarged fragmentary rear elevational view illustrating the adjustable dowels for establishing the desired key height.

In accordance with the invention, the back rail is provided with a series of adjustable dowels 27 by means of which the keys may be leveled. In the embodiment illustrated, the dowels are mounted on a back rail extension 28, which is a wooden rail secured to the rear surface of the back rails. As seen in FIG. 7, the dowels 27 are mounted on threaded pins 29 projecting upwardly from extension 28, the dowels being rotatable on the threaded pins to thereby raise or lower them, depending upon the direction of rotation. The dowels have felt pads 30 on their uppermost surfaces on which the rear ends of the keys 31 rest, there being one dowel for each key. With this arrangement it is not necessary to adjust the key height by adding or taking away punchings from under the balance rail. Rather, as will be apparent from FIG. 6, by raising or lowering the dowels 27 the fronts of the keys 31 may be readily leveled relative to front rail 10. Of course, the keys may be leveled in conventional fashion using punchings beneath the portions of the key supported on the balance rail, in which event the dowels may be eliminated and a felt strip applied to the upper surface of rear rail 12. However, the leveling dowels are preferred since the use of punchings is inconvenient because the action, which is mounted on the action brackets 32 secured to the key frame, must be loosened or removed and the keys removed from the key frame in order to change the number of punchings. While the action is not shown in its entirety the hammer and wippen rails are indicated at **32*a* and 32*b*, respectively, in FIG. 6**.

Figure 4A:
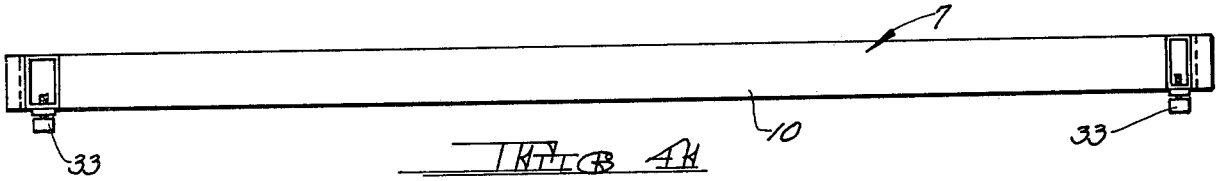
FIG. 4 is a front elevational view of the key frame illustrating the feet which support the key frame on the supporting brackets.

Another feature of the invention lies in the provision of adjustable feet 33 (seen in FIGS. 4, 6 and 7), at the four corners of the key frame 7, the feet having threaded stems 34 engaged in threaded openings in the undersurfaces of the end frames 13 and 14. Thus, the feet may be raised or lowered by rotating them in opposite directions. The feet, which are preferably provided with rubber cushions 35, are adapted to seat on the key bed brackets 8 and 9. To this end, the feet are preferably in the form of button-like members which will readily slide along the key bed brackets both during insertion and during lateral displacement of the key frame-key action assembly when the una-corda pedal is depressed. While preferably all four of the feet will be adjustable, so as to both vary the vertical position of the key frame as well as level it, leveling can be accomplished by making only one of the feet adjustable.

Figure 3:
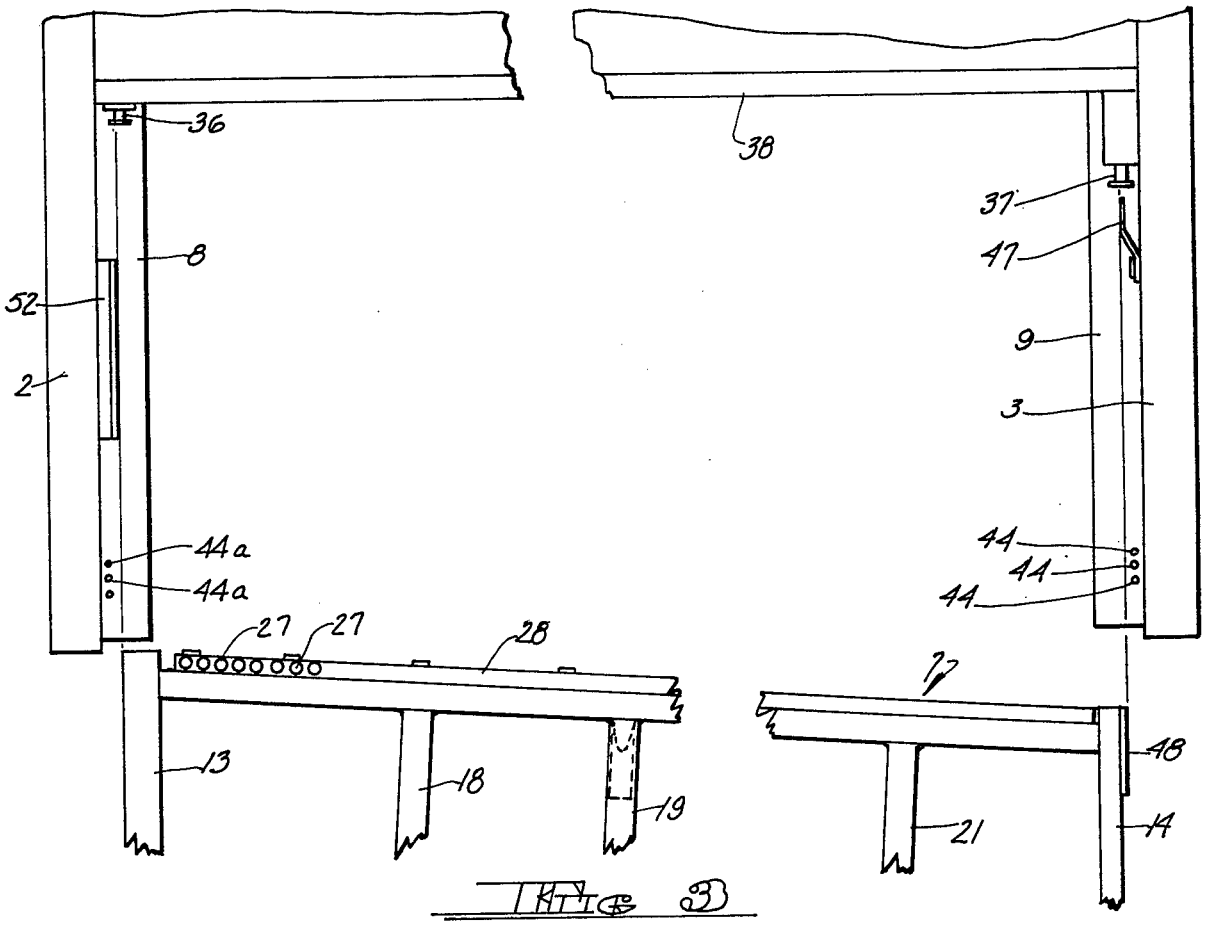
FIG. 3 is a fragmentary plan view with parts broken away illustrating the manner in which the key frame is slid onto the brackets which form a vestigial key bed.
Figure 5:
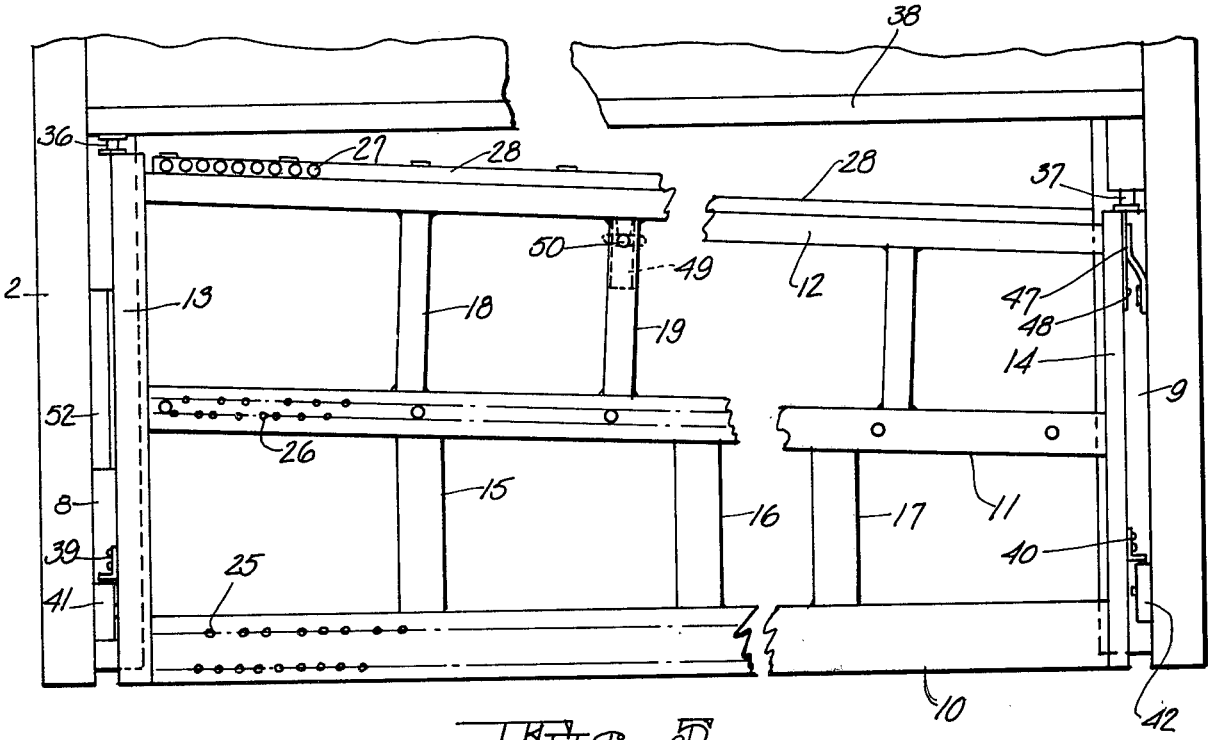
FIG. 5 is a fragmentary plan view similar to FIG. 4 illustrating the key frame in its assembled position.

As best seen in FIGS. 3 and 5, adjustable stops 36 and 37, which may be conveniently mounted on transverse brace member 38, are provided to accurately position the key frame-key action assembly when it is fitted into the piano case. The stops preferably will be similar to the adjustable feet 33 so as to provide accurate fore-to-aft alignment of the key frame assembly.

Figure 8:
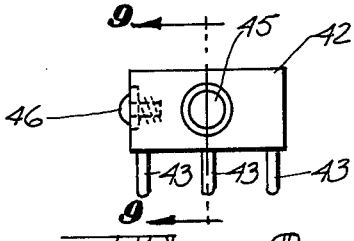
FIG. 8 is an enlarged side elevational view of the key blocks utilized to secure the key frame in position within the piano case.
Figure 9:
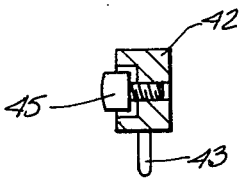
FIG. 9 is a vertical sectional view of the key block taken along the line 9—9 of FIG. 8.

Once the key frame assembly has been fitted into the case, it is secured in place by means of bracket members 39 and 40 secured to the outer sides of the end rail members 13 and 14, respectively, adjacent their front ends. These brackets are engaged by key blocks 41, 42 which are detachably secured to the key bed brackets 8 and 9 on which the key frame assembly is supported. The key block 42 is illustrated in FIGS. 8 and 9, the block having a set of depending pins 43 adapted to be received in mating openings 44 in key bed bracket 9 (see FIG. 3). On its inner face, the key block is provided with an adjustable stop 45 similar to the stops 36 and 37 which facilitates side-to-side positioning of the key frame assembly. The key block is also provided with a spring button 46 adapted to bear against the outwardly projecting leg of bracket 40. It will be understood that key block 41 will be of like construction, but of opposite hand, and will be fitted into openings 49*a* adjacent the front end of side rail 8 where it will bear against the outwardly projecting flange bracket 39.

The key frame assembly is normally biased in the direction of the left side of the casing, as represented by side frame member 2, by means of a leaf spring member 47 secured to the inner surface of the side frame member 3, the leaf spring member preferably bearing against a lubric pressure plate 48 (best seen in FIG. 6) secured to the outer surface of end rail 14 in a position to be contacted by the free end of the leaf spring when the key frame assembly is fitted in the case. The leaf spring, which is of known construction, permits lateral shifting of key frame assembly when the una-corda pedal is depressed. Thus, as seen in FIG. 5, a Y-shaped bracket 49 is mounted on the undersurface of crossrail 19 which engages the distal end of an actuating arm 50 (also seen in FIG. 1) which is actuated when the una-corda pedal 51 is depressed. When the una-corda pedal 51 is depressed, the lever 50 causes the entire frame assembly to shift laterally against the compression of leaf spring 47. In this connection, it will be understood that sufficient clearance will be provided between end rail 14 and key block 42 to permit the lateral shifting of the key frame assembly, stop 45 on key block 42 being adjusted to provide a stop for the key frame assembly when it is in shifted position. When the una-corda pedal is released, the leaf spring 47 will displace the key frame assembly in the opposite direction, with the end rail 13 at the base end of the piano seating against the adjustable stop on key block 41 and/or a felt covered stop block 52 seen in FIGS. 3 and 5.

As should now be apparent, a key frame constructed in accordance with the present invention provides a stiffer, less yielding structure than found in a conventional wooden key frame, and the key frame does not require a massive key bed to support it, thereby eliminating the problem of obtaining an accurate fit between the key frame and the key bed. While a key frame in accordance with the invention has a greater depth than that of a conventional wooden key frame, the elimination of the conventional massive key bed will compensate for the difference. Alternatively, the design of the piano case itself may be modified to insure that the knees of a seated pianist will fit comfortably beneath the undersurface of the piano in the area of the key frame. The bottom of the case in the area beneath the key frame may be closed by a relatively thin bottom cover indicated by dotted lines at 53 in FIG. 1.

Modifications may be made in the invention without departing from its spirit and purpose. A number of modifications have already been set forth and others will undoubtedly occur to the skilled worker in the art upon reading this specification. For example, the key bed brackets 8 and 9 can be provided with retractable extensions which, when extended, will permit the key frame assembly to be moved forwardly for adjustment while being supported by the extensions, so that the technician does not have to provide a separate work table while adjusting the instrument. Accordingly, it is not intended that the invention be limited other than in the manner set forth in the claims which follow.

The embodiments of the invention in which an exclusive property or privilege is claimed are defined as follows:

1. A key frame for a piano consisting essentially of a rigid, generally rectangular metal frame having a front rail, a balance rail and a back rail connected at their opposite ends to end rails, a plurality of spaced apart crossrails extending between and interconnecting said balance rail and said front and back rails at spaced apart intervals between said end rails, and mounting means on the undersurface of said key frame adjacent its corners for slidably mounting said key frame on a supporting surface.

2. The structure claimed in claim 1 wherein at least one of said mounting means includes adjustable means for leveling the key frame relative to said supporting surface.

3. The key frame claimed in claim 2 wherein said mounting means comprises feet secured to the undersurface of said key frame, and wherein said adjustable means comprises means for raising and lowering at least one of said feet relative to the undersurface of said key frame.

4. The key frame claimed in claim 3 wherein each of said feet is provided with an adjustable means for selectively raising and lowering each of said feet, whereby the vertical distance between the undersurface of said key frame and its underlying supporting surface may be varied.

5. The key frame claimed in claim 1 wherein the rails making up said key frame are formed from hollow tubing.

6. The key frame claimed in claim 5 wherein said hollow tubing is aluminum.

7. The key frame claimed in claim 6 wherein the rails making up said key frame are welded to each other.

8. The key frame claimed in claim 6 wherein the rails making up said key frame are interconnected by angle brackets the opposing flanges of which are secured to adjoining portions of the rails being joined.

9. The key frame claimed in claim 1 including vertically adjustable key leveling means mounted on said back rail.

10. The key frame claimed in claim 9 wherein said vertically adjustable key leveling means comprises a series of dowels rotatably mounted on threaded pins projecting upwardly relative to said back rail.

11. The key frame claimed in claim 10 wherein said threaded pins are mounted on an extension projecting rearwardly from and supported by said back rail.

12. The key frame claimed in claim 1 wherein said front and balance rails are of the same depth, and wherein said back rail is of a lesser depth, all of said rails having their undersurfaces lying in a common horizontal plane.

13. The key frame claimed in claim 12 wherein said end rails and the crossrails extending between said front rail and said balance rail are all of the same depth as said front and balance rails, and wherein the crossrails connecting said balance rail and said back rail are of the same depth as said back rail.

14. The key frame claimed in claim 1 in combination with a piano case having a rim structure including opposing side wall members adapted to receive said key frame therebetween, a pair of relatively narrow key bed brackets secured to and projecting inwardly from said wall members, said key bed brackets being horizontally disposed to jointly provide a supporting surface for said key frame mounting means.

15. The key frame claimed in claim 14 wherein said key bed brackets comprise rigid metal plates.

16. The key frame claimed in claim 15 including key blocks engagable with said key bed brackets adjacent the front ends thereof, and flanged brackets projecting outwardly from the end rails of said key frame in positions to be engaged by said key blocks when said key blocks are in engagement with said key bed brackets.

17. The key frame claimed in claim 16 including horizontally adjustable stops at the rear ends of said key bed brackets positioned to be contacted by the rear surface of said key frame when inserted in said case and supported on said key bed brackets.

* * * * *